US005856290A

United States Patent [19]

van Buskirk et al.

[11] Patent Number: 5,856,290

[45] Date of Patent: Jan. 5, 1999

[54] DISINFECTING CLEANSER FOR HARD SURFACES BASED ON MIXTURES OF APG AND $C_8$-$C_{18}$ ALKYL ETHER

[75] Inventors: Gregory van Buskirk, Danville, Calif.; Karl-Heinz Disch, Haan, Germany; Carsten Friese, Hamburg, Germany; Eva Kiewert, Duesseldorf, Germany; Birgit Middelhauve, Monheim, Germany

[73] Assignee: Henkel Kommanditgesellschaft auf Aktien, Duesseldorf, Germany

[21] Appl. No.: 700,188

[22] Filed: Aug. 20, 1996

Related U.S. Application Data

[62] Division of Ser. No. 312,354, Sep. 26, 1994, Pat. No. 5,576,284.

[51] Int. Cl.[6] ..... C11D 3/48; C11D 1/835; C11D 3/22; C11D 3/30

[52] U.S. Cl. ..... 510/382; 510/383; 510/384; 510/422; 510/423; 510/433; 510/470; 510/499; 510/504; 510/506

[58] Field of Search ..... 510/470, 382, 510/384, 422, 423, 433, 499, 504, 383, 506; 422/37, 28

[56] References Cited

U.S. PATENT DOCUMENTS

| | | | |
|---|---|---|---|
| H269 | 5/1987 | Malik | 422/37 |
| H468 | 5/1988 | Malik et al. | 510/435 |
| 3,547,828 | 12/1970 | Mansfield | 252/351 |
| 4,264,479 | 4/1981 | Flanagan | 8/137 |
| 4,483,779 | 11/1984 | Llenado et al. | 510/324 |
| 4,493,773 | 1/1985 | Cook et al. | 510/331 |
| 4,606,850 | 8/1986 | Malik | 510/420 |
| 4,627,931 | 12/1986 | Malik | 510/182 |
| 4,652,585 | 3/1987 | Gerhardt et al. | 514/563 |
| 4,668,422 | 5/1987 | Malik et al. | 510/135 |
| 4,748,158 | 5/1988 | Biermann et al. | 514/25 |
| 4,755,327 | 7/1988 | Bernarducci et al. | 510/319 |
| 4,775,424 | 10/1988 | Wisotzki et al. | 134/42 |
| 4,804,497 | 2/1989 | Urfer et al. | 510/292 |
| 4,920,100 | 4/1990 | Lehmann et al. | 514/23 |
| 5,035,814 | 7/1991 | Maaser | 8/137 |
| 5,185,145 | 2/1993 | Eggensperger et al. | 424/78.08 |
| 5,205,959 | 4/1993 | Schmid et al. | 510/422 |
| 5,234,618 | 8/1993 | Kamegai et al. | 510/382 |
| 5,276,047 | 1/1994 | Eggensperger et al. | 514/373 |
| 5,403,505 | 4/1995 | Hachmann et al. | 510/383 |
| 5,576,284 | 11/1996 | van Buskirk et al. | 510/384 |

FOREIGN PATENT DOCUMENTS

| | | |
|---|---|---|
| 94118 | 11/1983 | European Pat. Off. . |
| 106692 | 4/1984 | European Pat. Off. . |
| 0301298 | 7/1988 | European Pat. Off. . |
| 3444958 | 6/1986 | Germany . |
| 3619375 | 12/1987 | Germany . |
| 4007758 | 3/1990 | Germany . |
| 8605199 | 2/1986 | WIPO . |
| 8605509 | 3/1986 | WIPO . |
| 9003977 | 9/1989 | WIPO . |

*Primary Examiner*—Ardith Hertzog
*Attorney, Agent, or Firm*—Ernest G. Szoke; Wayne C. Jaeschke; Real J. Grandmaison

[57] ABSTRACT

A disinfectant-containing hard surface cleaner composition having increased bacteria count-reducing efficacy is provided by adding thereto a mixture of an alkyl or alkenyl oligoglycoside and certain $C_8$–$C_{18}$ alkyl ethers.

4 Claims, No Drawings

DISINFECTING CLEANSER FOR HARD SURFACES BASED ON MIXTURES OF APG AND $C_8$-$C_{18}$ ALKYL ETHER

This application is a divisional application of U.S. Ser. No. 08/312,354 filed on Sep. 26, 1994, now U.S. Pat. No. 5,576,284.

BACKGROUND OF THE INVENTION

1. Field of the Invention

The invention pertains to the use of alkyl glycosides and alkyl ethers for reinforcing the bacteria-reducing effects of disinfectant-containing cleaners for hard surfaces, as well as disinfecting cleaners for hard surfaces with selected disinfectants. Hard surfaces are defined as all non-textile surfaces occurring in the household, e.g., floors, work surfaces, kitchen equipment, sinks, shower stalls and bathtubs, toilet bowls, utensils, etc.

Disinfectant cleaning agents are known; however, up to now success has not been achieved in combining optimal cleaning performance and optimal disinfection efficacy. The usual disinfectant cleaners, for example, contain quaternary ammonium compounds in combination with nonionic surfactants; to be sure, such cleaners have adequate disinfectant action, but their cleaning performance leaves something to be desired. On the other hand, replacing the nonionic surfactants with anionic surfactants of strong cleaning intensity has the drawback that the disinfectant activity decreases greatly.

On the basis of the present invention it has become possible, starting from disinfectant-containing cleaners of the state of the art, to discover surfactant combinations which, in addition to good cleaning performance, ensure intensification of the bacteria-reducing efficacy of the disinfectants contained in the cleaners.

An additional task is that of developing cleaners for hard surfaces with selected disinfectant agents which display both good cleaning performance and good disinfectant activity.

2. Discussion of Related Art

German patents DE 3,444,958 and DE 3,619,375 describe the use of alkyl glycosides as potentiating agents for increasing the microbicidal efficacy of the biguanide compounds and of alcohols and carboxylic acids, especially in body care agents.

In international patent application WO 86/5199, cleaning agents are disclosed which contain alkyl glycosides, amine oxides, and quaternary ammonium compounds as surfactants.

The international patent application WO 86/5509 discloses disinfectant cleaners which contain alkyl glycosides as surfactant and quaternary ammonium compounds as disinfectant. However, the cleaning effect of these combinations leaves something to be desired.

Finally, in German Offenlegungsschrift DE 4,007,758, disinfecting cleaners for automatically-operated units for spray disinfection of hospital equipment are described, containing as disinfectant a quaternary ammonium compound and the reaction product of N-substituted propylene diamines with glutamic acid or glutamic acid esters.

None of the documents contained in the state of the art discloses the use of the special surfactant combination described in the following for intensifying the bacteria-reducing action of disinfectant-containing cleaners.

DESCRIPTION OF THE INVENTION

The problem described above, on which the invention is based, was solved by using a mixture of a) an alkyl and/or alkenyl oligoglycoside of Formula I $$R^1—O—[G]_p \quad (I)$$

in which $R^1$ represents a linear or branched alkyl or alkenyl group with 8 to 22 carbon atoms, [G] represents a glycose unit with 5 or 6 carbon atoms, preferably a glucose unit, and p represents a number from 1 to 10, and b) an alkyl ether of Formula II $$R^2O—(\overset{\overset{\displaystyle CH_3}{|}}{CH_2CHO})_x(CH_2CH_2O)_yH \quad (II)$$

in which $R^2$ represents a linear or branched aliphatic alkyl and/or alkenyl group with 8 to 18, preferably 8 to 14 carbon atoms, x represents 0 or a number of up to 3, preferably up to 2, and y represents a number from 1 to 15, preferably 2 to 12, especially 2.5 to 10.

This mixture guarantees intensification of the bacteria count-reducing action of disinfectant-containing cleaners for hard surfaces compared to disinfecting cleaners that contain only one or neither of the two surfactants mentioned.

Alkyl and/or alkenyl oligoglycosides represent known substances that can be obtained according to the relevant procedures of preparative organic chemistry. As a representative for the extensive literature, the documents EP-A1-0, 301,298 and WO 90/3977 may be mentioned here.

The alkyl and/or alkenyl oligoglycosides may be derived from aldoses or ketoses with 5 or 6 carbon atoms, preferably glucose. The preferred alkyl and/or alkenyl oligoglycosides are thus alkyl and/or alkenyl oligoglucosides.

The subscript p in general formula (I) gives the degree of oligomerization (DP), i.e., the distribution of mono- and oligoglycosides, and represents a number between 1 and 10. Whereas p must always be an integer in a given compound and here can particularly assume the values p=1 to 6, the value p for a specific alkyl oligoglycoside is an analytically-determined computational value which usually represents a fraction. Preferably, alkyl and alkenyl oligoglycosides with a mean degree of oligomerization p of 1.1 to 3.0 are used. From the viewpoint of applications technology, alkyl and/or alkenyl oligoglycosides are preferred, the degree of oligomerization of which is between 1.4 and 2.0.

The alkyl or alkenyl group $R^1$ can be derived from primary alcohols with preferably 8 to 11 carbon atoms. Typical examples are capryl alcohol, caprin alcohol, and undecyl alcohol as well as industrial mixtures thereof, as are obtained for example in the hydrogenation of industrial fatty acid methyl esters or during the hydrogenation of aldehydes from Roelen's oxo synthesis. Preferred are alkyl oligoglucosides of chain lengths $C_8$–$C_{10}$ (DP=1 to 3), which are obtained as first runnings in the distillative separation of $C_8$–$C_{18}$ coconut fatty alcohol and can be contaminated with a share of less than 6 wt % $C_{12}$ alcohol, as well as alkyl oligoglucosides based on technical $C_{9/11}$ oxo alcohols (DP=1 to 3).

The alkyl or alkenyl group $R^1$ can also be derived from primary alcohols with 12 to 22, preferably 12 to 14 carbon atoms. Typical examples are lauryl alcohol, myristyl alcohol, cetyl alcohol, palmoleyl alcohol, stearyl alcohol, isostearyl alcohol, oleyl alcohol, elaidyl alcohol, petroselinyl alcohol, arachyl alcohol, gadoleyl alcohol, behenyl alcohol, erucyl alcohol, and technical mixtures thereof.

The alkyl ethers of Formula II involve known nonionic surfactants that are obtained by addition of, first, propylene oxide and then ethylene oxide or ethylene oxide alone to fatty alcohols. Typical examples are alkyl ethers of Formula (II), in which $R^2$ represents an alkyl group with 12 to 18 carbon atoms, x represents 0 or 1, and y represents a number from 2 to 5. In this process, the subscripts x and y represent mean values. Additional, particularly suitable, alkyl ethers of Formula II include $C_{12-14}$ fatty alcohols containing 6 EO, octanol containing 4 EO and $C_{10-14}$ fatty alcohols containing 1 PO and 6 EO; EO represents ethylene oxide, PO represents propylene oxide. Preferably the alkyl ethers of Formula II may have a suitable homolog distribution; in these cases, formulations with particularly advantageous physical properties are obtained.

Theoretically, all commercial disinfectants suitable for application to hard surfaces, especially all hard surfaces occurring in the household, come under consideration as disinfectant constituents, also known as disinfectants. For example, it is possible to mention disinfectant-action quaternary phosphonium compounds, biguanide compounds (e.g., chlorhexidine), wherein to be sure, for example, phenols and aldehydes theoretically may be used, but for reasons of human toxicology, they preferably should not be used.

The above-described surfactant mixtures are especially suitable if the disinfectants are selected from the group consisting of A) nitrogenous substances obtained by reacting α) -N-substituted propylenediamines of Formula III $R^3—N(R^4)—CH_2—CH_2—CH_2—NH_2$ (III)

in which $R^3$ represents a linear alkyl group with 6 to 22 carbon atoms, preferably with 12 to 14 carbon atoms, and in which $R^4$ represents H or $CH_2—CH_2—CH_2—NH_2$ with compounds of Formula IV $$R^5—O—CO—CH_2—CH_2—\underset{\underset{NH_2}{|}}{CH}—COOH \quad (IV)$$

in which $R^5$ represents an alkyl group with 1 to 4 carbon atoms or a hydrogen atom, β) and optionally, further reacting the products obtained according to α with ethylene oxide or propylene oxide under alkoxylation conditions known in and of themselves, γ) and optionally, with salts of the products obtained according to α) or β) with inorganic or organic acids, B) aliphatic amines of Formula V, $$R^6—\underset{\underset{R^7}{|}}{N}—(CH_2)_n—NH_2 \quad (V)$$

in which n represents an integer from 2 to 6, preferably exactly 3, $R^6$ represents an alkyl group with 8 to 18 C atoms, $R^7$ represents hydrogen, an alkyl group with 8 to 18 C atoms or a $—(CH_2)_mNH_2$ group, in which m represents an integer from 2 to 6, preferably exactly 3, and C) the quaternary ammonium compounds of Formula VI $$R^9—\underset{\underset{CH_3}{|}}{\overset{\overset{R^8}{|}}{N}}—CH_3 \quad X^{\ominus} \quad (VI)$$

in which $R^8$ and $R^9$ represent alkyl groups with 8 to 16, preferably 10 to 14 C atoms, benzyl groups unsubstituted or substituted with one or two chlorine atoms or $C_1$–$C_4$ alkyl groups, or N- or S- containing heterocyclic groups, especially pyridyl, and $X^-$ represents an inorganic anion, preferably $Cl^-$ or $Br^-$, with the proviso that at least one of the groups $R^8$ or $R^9$ is an alkyl group with 8 to 16 C atoms, preferably 10 to 14 C atoms.

The nitrogen-containing substances listed under A) are compounds, the antimicrobial efficacy of which is known; in U.S. Patent No. 4,652,585, additional synthesis possibilities are described in detail. This document is specifically cited as a reference within the framework of the present invention.

The aliphatic amines mentioned under B) are tertiary amines that have at least one but preferably two ω-aminoalkyl groups, wherein linear alkyl groups with 2 to 6 C atoms, preferably the propyl group, are involved. Such substances are commercially available, e.g., N,N-bis-(3-aminopropyl)dodecylamine, which is sold by the Lonza Company under the name of Lonzabac 12.

The quaternary ammonium compounds mentioned under C) are likewise commercially available substances. Examples include dimethyl-dioctyl ammonium chloride, didecyl-dimethyl ammonium chloride, didodecyl-dimethyl ammonium chloride, dimethyl-ditetradecyl ammonium chloride, dihexadecyl-dimethyl ammonium chloride, decyl-dimethyl-octyl ammonium chloride, dimethyl-dodecyl-octyl ammonium chloride, benzyl-decyl-dimethyl ammonium chloride, benzyl-dimethyl-dodecyl ammonium chloride, benzyl-dimethyl-tetradecyl ammonium chloride, decyl-dimethyl-(ethylbenzyl) ammonium chloride, decyl-dimethyl-(dimethylbenzyl) ammonium chloride, (chlorobenzyl)-decyl-dimethyl ammonium chloride, decyl-(dichlorobenzyl)-dimethyl ammonium chloride and the compounds that contain acetate, propionate, or bromide as anions in place of chloride.

Some of the quaternary ammonium compounds mentioned, especially those with $C_{16}$ alkyl groups, in addition to their disinfectant action, under certain circumstances may also have textile fabric softening properties. Within the framework of the present invention, which pertains to disinfectant cleaners for hard surfaces, such additional textile fabric softening properties are entirely irrelevant.

The use of alkyl and/or alkenyl oligoglycosides of Formula I in a quantity of 0.1 to 20 wt % is especially preferred, particularly in a quantity of 0.2 to 10 wt %, based on the total cleaner composition; alkyl ethers of Formula II are preferably contained in a quantity of 0.05 to 20 wt %, especially 0.1 to 10 wt %, based on the total cleaner composition.

Intensification of the bacteria-reducing effect of the disinfectants contained in the cleaning agents is especially to be observed at disinfectant quantities of 0.01 to 5 wt %, especially 0.02 to 3 wt %, based on the total cleaner composition.

An additional object of the invention is disinfectant cleaners for hard surfaces that combine good cleaning power and good disinfectant efficacy in a very special way.

Such cleaners are obtained if alkyl and/or alkenyl oligoglycosides of Formula I with a chain length restricted to $C_8$ to $C_{10}$ is used, and otherwise the above-described alkyl ethers of Formula II are used, wherein alkyl chain lengths of $C_8$ to $C_{14}$ are preferred, and as the disinfectant one or more of the compounds listed above under A, B or C is used.

Particularly preferred, therefore, are aqueous disinfectant cleaning agents containing an alkyl and/or alkenyl oligoglycoside of Formula I, in which $R^1$ represents a linear alkyl or alkenyl group with 8 to 10 C atoms, in a quantity of 0.1 to 20 wt %, preferably 0.2 to 10 wt %, an alkyl ether of Formula II in a quantity of 0.05 to 20 wt %, preferably 0.1 to 10 wt %, and a disinfectant selected from the substances mentioned above under A, under B according to Formula V and under C according to Formula VI, in a quantity of 0.01 to 5 wt %, preferably 0.02 to 3 wt %, wherein all wt % statements are based on the total weight of the cleaning agent.

The cleaning agents in accordance with the invention show particularly positive properties when the disinfectant is selected from the substances mentioned above under A and the substances mentioned above under B, wherein in Formula V, n represents 3, $R^6$ represents an alkyl group with 12 to 16 C atoms and $R^7$ is aminopropyl group.

All the substances used in the cleaning agents naturally cannot only be used as pure substances, but also in the form of mixtures of various representatives of a compound class; for example, the simultaneous use of a $C_{8-10}$ alkyl glycoside and a $C_{12-16}$ alkyl glycoside is possible (e.g., in a 10:1 to 1:2 ratio), or the simultaneous use of an ethoxylated alkyl ether and an alkyl ether that is both propoxylated and ethoxylated.

In addition, mixtures of disinfectants can also be used, for example, a disinfectant mentioned under A together with a disinfectant mentioned under B.

In addition to the alkyl and/or alkenyl oligoglycosides of Formula I and the alkyl ethers of Formula II, additional nonionic surfactants may also be present in quantities of up to 20 wt %, based on the total quantity of cleaning agent. These include, for example, products of ethylene oxide addition to fatty acids, fatty amines, or fatty acid amides. The end group-capped derivatives of such alkoxylation products, preferably with end groups containing 2 to 10 C atoms, also come under consideration.

In addition, if desired, amphoteric or zwitterionic surfactants may be contained in a quantity of up to 10 wt %, based on the total quantity of cleaner. Suitable amphoteric surfactants include derivatives of tertiary aliphatic amines or quaternary aliphatic ammonium compounds, the aliphatic groups of which may be straight-chain or branched, and one of which contains a carboxy, sulfo, phosphono, sulfato or phosphato group. Examples of such amphoteric surfactants are dimethyl-tetradecyl glycine, dimethyl-hexadecyl glycine, dimethyl-octadecyl glycine, 3-(dimethyl-dodecylammonio)-1-propane sulfonate and the amphoteric surfactants sold under the names of Dehyton® AB, CB, K and G (Supplier: Henkel KGaA, Duesseldorf, Germany.

Anionic surfactants such as aliphatic alcohol sulfates, aliphatic alcohol ether sulfates, or α-olefin sulfonates, to be sure, may be theoretically present in small amounts of up to 10 wt %, especially up to 5 wt %, based on the total quantity of cleaning agent; however, a maximum of 2 wt % anionic surfactants are preferably contained in the cleaning agents described. It is obvious to the expert that the compatibility of the anionic surfactants with the disinfectant agents contained in the cleaner in terms of the bacteria-reducing action must be verified.

In addition, the cleaning agents described may contain water-soluble organic solvents, preferably from the groups of alcohols with 1 to 4 C atoms, glycols with 2 to 4 C atoms, and diglycols and diglycol ethers that can be derived from these. Such solvents are, for example, methanol, ethanol, propanol, isopropanol, tert.-butanol, ethylene glycol, propylene glycol, butylene glycol, diethylene glycol, dipropylene glycol, diethylene glycol monomethyl ether, diethylene glycol monoethyl ether, diethylene glycol monopropyl ether, and diethylene glycol monobutyl ether. Organic solvents can be present in quantities of about 5 to 40, preferably about 10 to 20 wt. %.

In addition, the cleaners can contain the usual additives, e.g., dyes or perfumes, thickeners, hydrotropes, clouding agents, etc.

Amine oxides are preferably contained in quantities of at most, up to 2 wt %; in particular, disinfectant cleaners according to the invention, however, are free from amine oxides.

An additional object of the invention is a process for disinfectant cleaning of hard surfaces, characterized in that one of the disinfectant-containing cleaning agents as described above is applied in undiluted form or in the form of a preparation diluted with water to a hard surface, and then the surface is cleaned in the usual way.

If the cleaning agent is applied without dilution, the content of disinfectant is 0.01 to 5 wt %, based on the total cleaner.

If the cleaning agent is diluted with water, a use dilution of 0.001 to less than 5 wt %, especially 0.001 to 0.05 wt %, is advantageous.

In order to guarantee a clear use dilution even when the cleaners are used with hard water, the cleaners may contain complexing agents. These may include, e.g., the sodium salts of methane diphosphonic acid, hydroxyethane-1,1-diphosphonic acid, 1-aminoethane-1,1-diphosphonic acid, amino-trimethylene phosphonic acid, ethylene diamine-tetra (methylene phosphonic acid), diethylene triamine-penta (methylene phosphonic acid), 2-phos-phonobutane-1,2,4-tricarboxylic acid, and nitrilotriacetic acid (NTA). Citrates and gluconates or salts of glutaric, adipic, and succinic acids are preferred. Complexing agents of this type are contained in the cleaning agents, preferably in quantities of no more than 10 wt %, especially about 0.5 wt % to 4 wt %.

EXAMPLES

| Raw materials Used: | Chemical Description |
|---|---|
| Dodigen 1611 (Hoechst Co.) | Coconut alkyl-dimethyl-benzyl ammonium chloride |
| Lonzabac 12 (Lonza Co.) | N,N-bis(3-aminopropyl)-$C_{12}$ alkylamine |
| Bardac 22 (Lonza Co.) | Didecyl-dimethyl-ammonium chloride |
| Disinfectant I | Reaction product of coconut propylene-1,3-diamine with L-glutamic acids, prepared according to U.S. Pat. No. 4,652,585 |
| Aliphatic alcohol alcohol ethoxylates: | The alkyl chain of the fatty alcohol (FA) and the moles of ethylene oxide (EO) or propylene oxide (PO) are given. NRE indicates FA alkoxylates with restricted homolog distribution (narrow range ethoxylates) |
| Glucopon 225 (Henkel Co.) | $C_{8-10}$-alkyl-1.6-glucoside |
| Glucopon 600 (Henkel Co.) | $C_{12-16}$-alkyl-1.4-glucoside |
| Sokalan DCS (BASF Co.) | Sodium salt of a dicarboxylic acid mixture (adipic, glutaric, succinic acids) |

TEST METHODS

Determination of Bacterial Reduction

The bacteria-reducing efficacy of the cleaning agents was tested in a quantitative suspension test following the Guidelines for the Testing and Evaluation of Chemical Disinfectants of the German Association for Hygiene and Microbiology (DGHM), Status 1981, against the bacterial strain *Pseudomonas aeruginosa.* For this purpose in each case 10 ml of the cleaner to be tested was mixed with 0.1 ml of a bacterial suspension (ca. $10^8$–$10^9$ bacteria per ml) at 20° C. After a contact time of 5 or 10 min, in each case 1 ml of this mixture was introduced into 10 ml of an aqueous inhibitor removal solution, containing 3.0 wt % Tween® 80, 0.3 wt % lecithin and 0.1 wt % histidine. From each of these samples and additional 1:10 dilution steps, 0.1 ml were placed on casein-soy agar plates. Following incubation of these subcultures (48 hr at 30° C.), the number of viable organisms was determined. For comparison, aqueous solutions of the individual components and water free from cleaning agents was tested under the same conditions. The difference between the active ingredient batch and the negative controls is given in the table as a logarithm (=reduction factor, [log steps]).

Determination of the Cleaning Capacity

To test the cleaning capacity, the method described below according to "*Seifen-Öle-Fette-Wachse*", 112, 371, (1986) was used; this gives highly reproducible results. According to this, the cleaning agent to be tested was applied to an artificially-soiled plastic surface. The artificial soil used for the dilution of the cleaning agent was a mixture of soot, machine oil, triglyceride saturated fatty acids, and lower-boiling aliphatic hydrocarbons. The test surface of 26×28 cm was coated uniformly with 2 g of the artificial soil using a surface spreader.

In each case a plastic sponge was saturated with 10 ml of a 1 wt % aqueous solution of the cleaning agent being tested and moved mechanically over the test surface, to which 10 ml of a 1 wt % solution of the cleaning agent to be tested had likewise been applied.

After 10 wiping movements the cleaned test surface was held under running water, and the loose soil was removed. The cleaning effect, i.e., the whiteness of the plastic surface cleaned in this way, was measured with a "Microcolor" color difference measuring apparatus (Dr. B. Lange). The white standard used was the clean white plastic surface.

Since in the measurement, the clean surface was set at 100% and the soiled surface at 0%, the values read for the cleaned plastic surfaces are equated to the percentage cleaning capacity (% CC). In the experiments that follow the % CC values given are the values determined by this method for the cleaning capacity of the cleaners studied. Each of them represents mean values from 3 determinations.

The measured values were set in proportion to the cleaning result with a strong-cleaning, non-disinfecting cleaning agent used as a standard.

$$\frac{\text{Measured value sample} \cdot 100}{\text{Measured value standard}} = \%\,CC\ \text{relative}$$

The "% CC relative" values obtained in this way are given in the tables that follow.

The non-disinfecting cleaning agents used as the standard have the following composition:

2.0% alkane sulfonate 1.5% aliphatic alcohol ethoxylate 0.5% soap 4.0% butyl diglycol to make 100% water, perfume and dye.

Disinfecting agents of the following compositions were prepared (values in wt %):

TABLE 1

| Agent | 1 | 2 (V) | 3 (V) |
|---|---|---|---|
| Glucopon 225 | 5 | — | 5 |
| $C_{12-14}$-FA + 6 EO | 5 | 10 | — |
| $C_{12-14}$-FA + 5 EO + 5 PO | — | — | 5 |
| Disinfectant I | 1 | 1 | 1 |

TABLE 1-continued

| Agent | 1 | 2 (V) | 3 (V) |
|---|---|---|---|
| Sokalan DCS | 5 | 5 | 5 |
| Water | to 100 | to 100 | to 100 |

Composition 1 is in accordance with the invention, 2(V) and 3(V) are comparison examples. The bacterial count reduction determination (contact time 5 min) gave the following results:

1:log 4

2(V):log 2

3(V):log 2

It can be seen that composition 1 in accordance with the invention shows better bacterial reduction by two orders of magnitude compared to compositions 2(V) and 3(V).

TABLE 2

| Agent | 4 | 5 (V) |
|---|---|---|
| Glucopon 225 | 6 | 8 |
| $C_8$-FA + 1 PO + 9 EO | 2 | — |
| Disinfectant I | 0.5 | 0.5 |
| Bardac 22 | 0.5 | 0.5 |
| Sokalan DCS | 5 | 5 |
| Water | to 100 | to 100 |

The determination of the cleaning capacity gave the following results:

4:70% CC relative

5(V):60% CC relative

Composition 4 is in accordance with the invention, and 5(V) is a comparison example.

Both compositions have adequate disinfectant efficacy; however, it is apparent that the joint use of Glucopon 225 and $C_8$–FA+1PO+9 EO leads to an increase in the cleaning capacity.

TABLE 3

| Agent | 6 | 7 | 8 | 9 | 10 |
|---|---|---|---|---|---|
| Nonylphenol + 10 EO | — | — | — | — | — |
| Glucopon 225 | 6 | 4 | 5 | 5 | 5 |
| Glucopon 600 | — | 2 | — | — | — |
| $C_{12-14}$—FA + 2.5 EO (NRE) | — | — | 1 | 1 | — |
| $C_8$—FA + 4 EO | 1 | — | — | — | |
| $C_{12-14}$—FA + 6 EO | 1 | 3.5 | — | — | 5 |
| $C_{10-14}$—FA + 1 PO + 6 EO | — | — | — | — | — |
| $C_8$—FA + 1 PO + 9 EO | — | — | 1 | 3 | — |
| $C_{8-18}$-Alkylamidopropyl-Betaine | — | 0.5 | — | — | — |
| $C_{8-18}$-Alkyldimethylamineoxide | — | — | 0.5 | — | — |
| Ethanol | 3 | — | 5 | — | — |
| Isopropanol | — | 3 | — | 3 | — |
| Disinfectant I | 1 | 1 | 1 | 1 | 1 |
| Dodigen 1611 | — | — | — | — | — |
| Lonzabac | — | — | — | — | — |
| Bardac 22 | — | — | — | — | — |
| Cocosalkyldimethylbenzy1-ammonium chloride | — | — | — | — | — |
| Sokalan DCS | 2.5 | — | — | — | 5 |
| Trisodium Citrate | — | 2 | — | — | — |
| Na-Gluconate | — | — | 5 | 5 | — |
| Ethylenediaminetetraacetate | — | — | — | — | — |
| Cleaning capacity (% Rv-relativ) | 85 | 82 | 80 | 79 | 70 |
| Bacteria reduction (contact time 10 Min.) | log >5 | log >5 | log <5 | log >5 | log >5 |

TABLE 3-continued

| Agent | 11 | 12 | 13 | 14 | 15 |
|---|---|---|---|---|---|
| Nonylphenol + 10 EO | — | — | — | — | — |
| Glucopon 225 | 8 | 8 | 6.29 | 4.02 | 1.46 |
| Glucopon 600 | — | — | — | — | — |
| $C_{12-14}$—FA + 2.5 EO (NRE) | — | — | — | — | — |
| $C_8$—FA + 4 EO | — | — | — | — | — |
| $C_{12-14}$—FA + 6 EO | — | — | 1.5 | 1.5 | 4.86 |
| $C_{10-14}$—FA + 1 PO + 6 EO | 2 | 2 | — | — | — |
| $C_8$—FA + 1 PO + 9 EO | — | — | — | — | — |
| $C_{8-18}$-Alkylamidopropyl-Betaine | 1 | 1 | — | 0.68 | 1.10 |
| $C_{8-18}$-Alkyldimethylamineoxide | — | — | — | — | — |
| Ethanol | — | — | — | — | — |
| Isopropanol | — | — | — | — | — |
| Disinfectant I | — | 0.5 | 1 | 1 | 1 |
| Dodigen 1611 | 1 | — | — | — | — |
| Lonzabac | — | — | — | — | — |
| Bardac 22 | — | 0.5 | — | — | — |
| Cocosalkyldimethylbenzyl-ammonium chloride | — | — | — | — | — |
| Sokalan DCS | 5 | 5 | 2.25 | 3.80 | 2.58 |
| Trisodium Citrate | — | — | — | — | — |
| Na-Gluconate | — | — | — | — | — |
| Ethylenediaminetetraacetate | — | — | — | — | — |
| Cleaning capacity (% Rv-relativ) | 75 | 80 | 87 | 81 | 85 |
| Bacteria reduction (contact time 10 Min.) | log 4 | log >5 | log >5 | log >5 | log 5 |

| Agent | 16 | 17 | 18 | 19(V) |
|---|---|---|---|---|
| Nonylphenol + 10 EO | — | — | — | 4 |
| Glucopon 225 | 2.80 | 3.94 | 3.72 | — |
| Glucopon 600 | — | — | — | — |
| $C_{12-14}$—FA + 2.5 EO (NRE) | — | — | — | — |
| $C_8$—FA + 4 EO | — | — | — | — |
| $C_{12-14}$—FA + 6 EO | 3.88 | 3.47 | 2.79 | — |
| $C_{10-14}$—FA + 1 PO + 6 EO | — | — | — | — |
| $C_8$-FA + 1 PO + 9 EO | — | — | — | — |
| $C_{8-18}$-Alkylamidopropyl-Betaine | 0.97 | 0.41 | 1.23 | — |
| $C_{8-18}$-Alkyldimethylamineoxide | — | — | — | — |
| Ethanol | — | — | — | — |
| Isopropanol | — | — | — | — |
| Disinfectant I | 1 | 1 | — | — |
| Dodigen 1611 | — | — | — | — |
| Lonzabac | — | — | — | — |
| Bardac 22 | — | — | — | — |
| Cocosalkyldimethylbenzyl-ammonium chloride | — | — | — | 1 |
| Sokalan DCS | 2.35 | 2.18 | 2.26 | — |
| Trisodium Citrate | — | — | — | — |
| Na-Gluconate | — | — | — | — |
| Ethylenediaminetetraacetate | — | — | — | 0.5 |
| Cleaning capacity (% RV-relativ) | 83 | 82 | 84 | 41 |
| Bacteria reduction (Contact time 10 Min.) | log >5 | log >5 | log >5 | — |

Desinfekstionsmittel = disinfectant; Wasser = water; Reinigungsvermögen = cleaning capacity; Keimreduktion = bacteria reduction; Einwirkungszeit = contact time The compositions 6 to 18 used in accordance with the invention have good cleaning capacity and good bacteria-reducing efficacy. The composition 19, used for comparison, shows a distinctly poorer cleaning capacity.

What is claimed is:

1. The process of increasing the bacteria count-reducing efficacy of a hard surface disinfectant-cleaner composition containing from 0.01% to 5% by weight of a disinfectant comprising nitrogenous substances obtained by reacting α) -N-substituted propylene diamines corresponding to formula III $R^3—N(R^4)—CH_2—CH_2—CH_2—NH_2$ (III)

in which $R^3$ represents a linear alkyl group with 6 to 22 carbon atoms, and in which $R^4$ represents H or $CH_2—CH_2—CH_2—NH_2$ with compounds corresponding to formula IV $$R^5—O—CO—CH_2—CH_2—\underset{\underset{NH_2}{|}}{CH}—COOH \quad (IV)$$

in which $R^5$ represents an alkyl group with 1 to 4 carbon atoms or hydrogen atom, β) and optionally further reacting the products obtained according to α) with ethylene oxide or propylene oxide, γ) and optionally, with salts of the products obtained according to α) or β) with inorganic or organic acids, comprising adding to said composition a mixture of:

a) from 0.2% to 10% by weight of an alkyl or alkenyl oligoglycoside corresponding to formula I $R^1—O—[G]_p$ (I)

in which $R^1$ represents a linear or branched alkyl or alkenyl group with 8 to 22 carbon atoms, [G] represents a glycose unit with 5 or 6 carbon atoms, and p represents a number from 1 to 10, and (b) from 0.1% to 10% by weight of an alkyl ether corresponding to formula II $$R^2O—(\underset{\underset{CH_3}{|}}{CH_2CHO})_x(CH_2CH_2O)_yH \quad (II)$$

in which $R^2$ represents a linear or branched aliphatic alkyl or alkenyl group with 8 to 18 carbon atoms, x represents 0 or a number of up to 3, and y represents a number from 1 to 15, all weights being based on the weight of said composition.

2. A process as in claim 1 wherein said composition further contains quaternary ammonium compounds corresponding to formula VI $$R^9—\underset{\underset{CH_3}{|}}{\overset{\overset{R^8}{|}}{N}}—CH_3 \quad X^{\ominus} \quad (VI)$$

3. The process of cleaning and disinfecting a hard surface comprising contacting said surface with a disinfectant-cleaner composition containing from 0.01% to 5% by weight of a disinfectant comprising nitrogenous substances obtained by reacting α) -N-substituted propylene diamines corresponding to formula III $R^3—N(R^4)—CH_2—CH_2—CH_2—NH_2$ (III)

in which $R^3$ represents a linear alkyl group with 6 to 22 carbon atoms, and in which $R^4$ represents H or $CH_2—CH_2—CH_2—NH_2$ with compounds corresponding to formula IV $$R^5—O—CO—CH_2—CH_2—\underset{\underset{NH_2}{|}}{CH}—COOH \quad (IV)$$

in which $R^5$ represents an alkyl group with 1 to 4 carbon atoms or hydrogen atom, β) and optionally further reacting the products obtained according to α) with ethylene oxide or propylene oxide, γ) and optionally with salts of the products obtained according to α) or β) with inorganic or organic acids, and a mixture of a) from 0.2% to 10% by weight of an alkyl or alkenyl oligoglycoside corresponding to formula I $R^1—O—[G]_p$ (I)

in which $R^1$ represents a linear or branched alkyl or alkenyl group with 8 to 22 carbon atoms, [G] represents a glycose unit with 5 or 6 carbon atoms, and p represents a number from 1 to 10, and b) from 0.1% to 10% by weight of an alkyl ether corresponding to formula II $$R^2O—(CH_2\overset{\overset{\displaystyle CH_3}{|}}{C}HO)_x(CH_2CH_2O)_yH \quad \text{(II)}$$

in which $R^2$ represents a linear or branched aliphatic alkyl or alkenyl group with 8 to 18 carbon atoms, x represents 0 or a number of up to 3, and y represents a number from 1 to 15, all weights being based on the weight of said composition.

4. A process as in claim 3 wherein said composition further contains quaternary ammonium compounds corresponding to formula VI $$R^9—\overset{\overset{\displaystyle R^8}{|}}{\underset{\underset{\displaystyle CH_3}{|}}{N}}^{\oplus}—CH_3 \quad X^{\ominus} \quad \text{(VI)}$$

in which $R^8$ and $R^9$ represent alkyl groups with 8 to 16 carbon atoms, benzyl groups unsubstituted or substituted with one or two chlorine atoms or $C_1$–$C_4$ alkyl groups, or N- or S-containing heterocyclic groups, and $X^{\ominus}$ represents an inorganic anion, with the proviso that at least one of the groups $R^8$ or $R^9$ is an alkyl group with 8 to 16 carbon atoms.

* * * * *